US006716120B1

(12) United States Patent
Normand

(10) Patent No.: US 6,716,120 B1
(45) Date of Patent: Apr. 6, 2004

(54) HOCKEY TRAINING AID

(76) Inventor: John Normand, 35 Seaview Ave., Hampton, NH (US) 03842

( * ) Notice: Subject to any disclaimer, the term of this patent is extended or adjusted under 35 U.S.C. 154(b) by 12 days.

(21) Appl. No.: 10/214,138

(22) Filed: Aug. 8, 2002

(51) Int. Cl.[7] ..... A63B 69/00; A63B 59/12

(52) U.S. Cl. ..... 473/446; 473/422; 473/425; 473/560; 273/108.5

(58) Field of Search ..... 473/422, 438, 473/441–443, 446, 471, 478, 559–563, 423–425, 189, 196, 197–199, FOR 132; 273/317, 317.1, 334, 335, 108, 108.1, 108.5

(56) References Cited

U.S. PATENT DOCUMENTS

| | | | | |
|---|---|---|---|---|
| 3,844,555 | A | 10/1974 | Tremblay | |
| 3,863,917 | A | 2/1975 | Beale | |
| 4,023,797 | A | 5/1977 | Sarrasin | |
| 4,111,419 | A | 9/1978 | Pellegrino | |
| 5,120,055 | A | 6/1992 | McCarthy et al. | |
| 5,816,945 | A | 10/1998 | Todd et al. | |
| 6,234,923 | B1 * | 5/2001 | Gentile | 473/563 |
| 6,569,041 | B1 * | 5/2003 | Riivald | 473/446 |

FOREIGN PATENT DOCUMENTS

| | | |
|---|---|---|
| CA | 2160746 | 1/1999 |
| CA | 2193517 | 8/1999 |

* cited by examiner

*Primary Examiner*—Paul T. Sewell
*Assistant Examiner*—Mitra Aryanpour
(74) *Attorney, Agent, or Firm*—Richard C. Litman

(57) ABSTRACT

The hockey training aid is a blade having a shank for inserting a stick handle and containing a channel along the lower edge of the blade. A string is fastened at one end to a puck and at the other end to a ball-shaped bead that is freely movable within the channel. The string attached to the bead extends outward from the channel through a slit that also extends along the length of the channel. During use, as the puck moves back-and-forth during stick-handling drills, the bead freely moves back-and-forth within the channel and the tether freely moves along the slit. An additional optional hole is provided at the top of the blade for use as an alternative stationary attachment of an elastic tether to the blade.

16 Claims, 6 Drawing Sheets

HOCKEY TRAINING AID

BACKGROUND OF THE INVENTION

1. Field of the Invention

The present invention relates to hockey training aids and, more specifically, to a hockey training aid made of a hockey blade and a puck tethered to the hockey blade so that a novice hockey player can practice stickhandling, puckhandling and self-passing drills.

2. Description of the Related Art

The present invention fills a need for a hockey training aid which can be used in off-ice settings, e.g., floor or street, to practice stick-handling and puck control skills in hockey. A puck is tethered to the lower portion of the blade of the hockey stick so that the puck can be repeatedly struck by the blade to conduct such stick-handling and puck control drills as short and wide dribbles, receiving passes, deflecting shots, etc. The puck is tethered to the blade with a bead that is movable along a channel in the lower portion of the blade. Also, the blade includes an additional hole to attach an elastic string to a puck for using in self-passing drills.

Furthermore, the blade can also include a riveted side piece that encloses the channel containing the movable bead.

U.S. Pat. No. 3,844,555 issued to Tremblay, on Oct. 29, 1974, teaches a hockey blade which can be used to practice with balls, e.g., for field hockey practice. The ball is trapped within a U-shaped enclosure created by the shape of the blade. The blade can be made of wood or plastic.

U.S. Pat. No. 3,863,917, issued to Beale on Feb. 4, 1975, teaches a hockey blade with a tethered puck in which the blade includes several apertures to which the puck can be selectively attached with an elastic cord. The particular hole to which the elastic string is attached to the blade determines the area of the blade being drilled, i.e., toe area versus heel area.

U.S. Pat. No. 4,023,797, issued to Sarrasin on May 17, 1977, teaches a hockey blade in which a puck is tethered to a fishing-rod-like spool and reel arrangement on the shaft of the stick that acts as a shock absorber cushioning the forces exerted on the A elastic tether when the puck is struck.

U.S. Pat. No. 4,111,419, issued to Pellegrino on Sept. 15, 1978, teaches a hockey blade with a puck tethered to a C-shaped clamp on top of the blade. The tether in this patent has at least two sections, one of which is intended to break readily when a known predetermined breaking point is reached.

U.S. Pat. No. 5,120,055, issued to McCarthy et al. on Jun. 9, 1992, teaches a hockey stick with an easily attachable and detachable tethered puck. A spring clip attaches the tether to the top of the blade.

U.S. Pat. No. 5,816,945, issued to Todd et al. on Oct. 6, 1998, teaches a hockey stick with a tethered puck in which the tether is attached to the stick using a hook-and-loop fastener, e.g., Velcro® hook-and-loop.

Canadian Patent No. 2,160,746 teaches a puck elastically tethered to a linear guide positioned between a shooting station and a target (goal). When struck, the puck is limited in its travel between the two ends of the guide.

Canadian Patent No. 2,193,517 teaches a puck attached to the sides of a goal using two tethers, one to each side. This arrangement is useful for practice in making or deflecting shots at the goal by offensive players and by goaltenders.

None of the above inventions and patents, taken either singly or in combination, is seen to describe the instant invention as claimed. Thus a hockey training aid solving the aforementioned problems is desired.

SUMMARY OF THE INVENTION

The invention is directed to a hockey training aid. More particularly, the training aid is a hockey blade tethered to a hockey puck by a string. The string is attached at one end to the puck and at the other end to a bead which is freely movable along a channel located inside the lower edge of the blade. The channel includes a slit along its length that permits the string to move freely with the bead as the puck is struck with the blade. In addition, the lower edge of the blade includes a lengthwise horizontal notch that extends between the heel and the toe of the blade along the lower edge of the blade, permitting the puck to be handled on both sides of the blade (i.e., forehand and backhand) without the blade interfering with the back-and-forth movement of the string as the bead travels within the channel.

Accordingly, it is a principal object of the invention to provide a hockey training aid in which a hockey puck is tethered to a hockey blade and permits the user to practice using the blade in either forehand or backhand positions.

It is another object of the invention to provide a hockey training aid as described above in which the blade contains a channel and corresponding slit along the length of the lower edge of the blade, the string being connected to the blade by having a bead at one end of the string that is freely movable within the channel while the string is freely movable along the slit.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is directed to a hockey training aid having a blade which is tethered to a puck.

Figure 1:
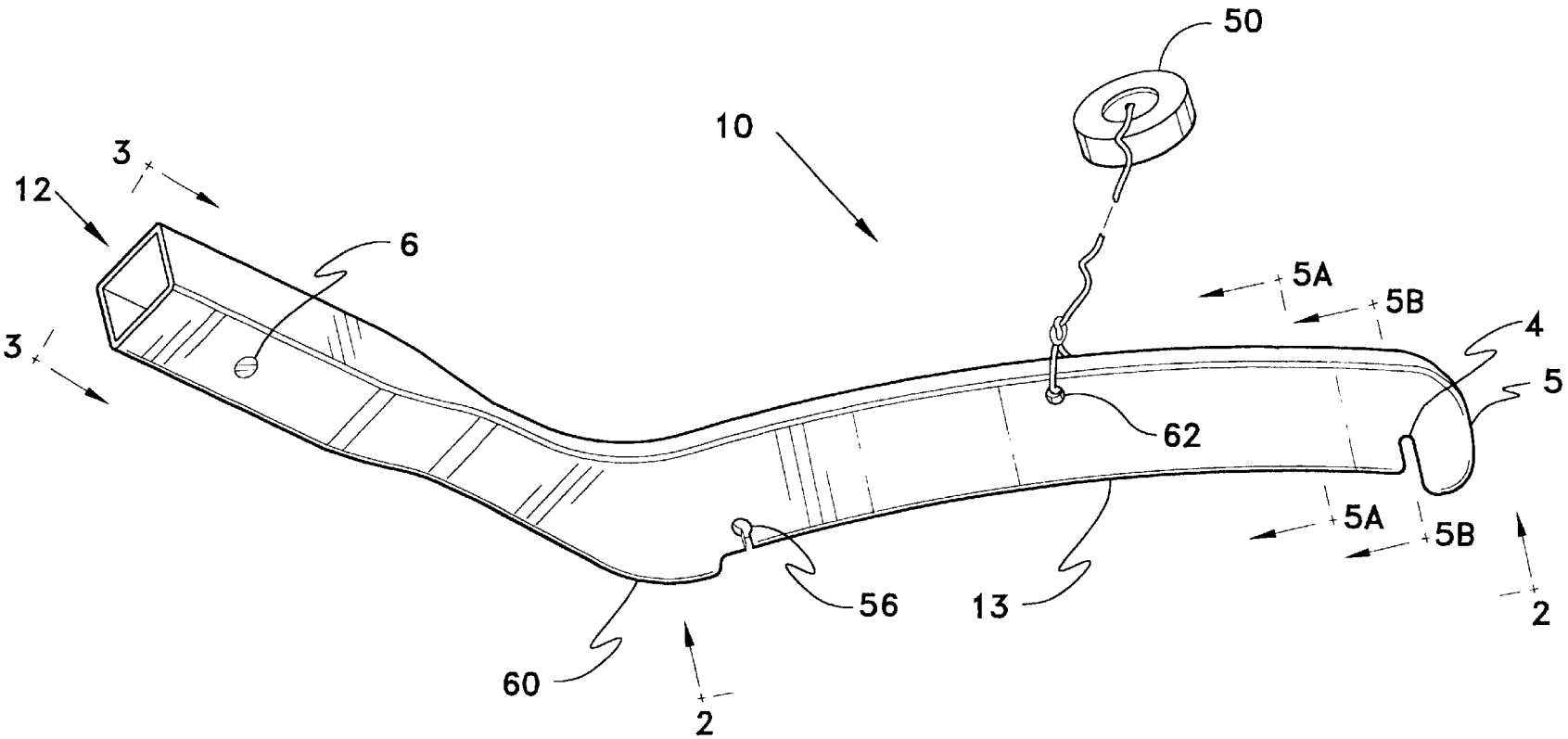
FIG. 1 is a perspective view of the blade of a hockey training aid according to the present invention.

FIG. 1 shows a perspective view of the hockey training aid showing the lower edge 13 and a side of the blade 10 used for hitting the puck 50. Also, the top portion 12 having an opening is shown into which a conventional stick handle is inserted and fastened in place using appropriate fastening elements 6, e.g., screws. The blade toe 5, blade heel 60 and a toe notch 4 are also shown.

The specially designed toe notch 4 is vertically oriented near the tip of the blade. It permits the user to practice "curl and drag" maneuvers near the toe 5 of the blade 10.

As shown more particularly in FIG. 1, a central portion of the bottom edge 13 of the blade 10 is preferably raised above a supporting surface, such as a floor or the ground, by virtue of a shoulder between the heel 60 and notch 56 at the rear of the blade, and by the protruding leading edge of the notch 4 at the toe 5 of the blade 10. The central portion of the bottom edge 13 of the blade 10 is raised sufficiently so that the puck may be passed beneath the blade 10 when switching from forehand to backhand positions without trapping the tether between the lower edge of the blade 10 and the playing surface. The central portion is preferably raised about ½-inch high above the playing surface.

Figure 3:
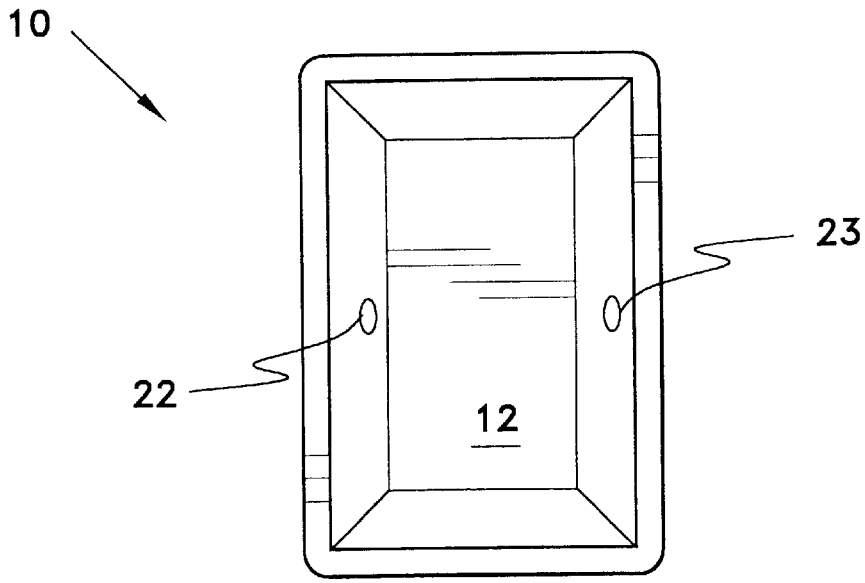
FIG. 3 is a top view of the handle-insertion portion of the top of the hockey training blade as viewed in the direction of lines 3—3 of FIG. 1.

A close-up view of the top portion 12 opening of the blade 10 is shown in FIG. 3. Holes 22 and 23 are provided for fastening elements, e.g., screws, to hold the handle in place in the top of the blade 10.

Figure 2:
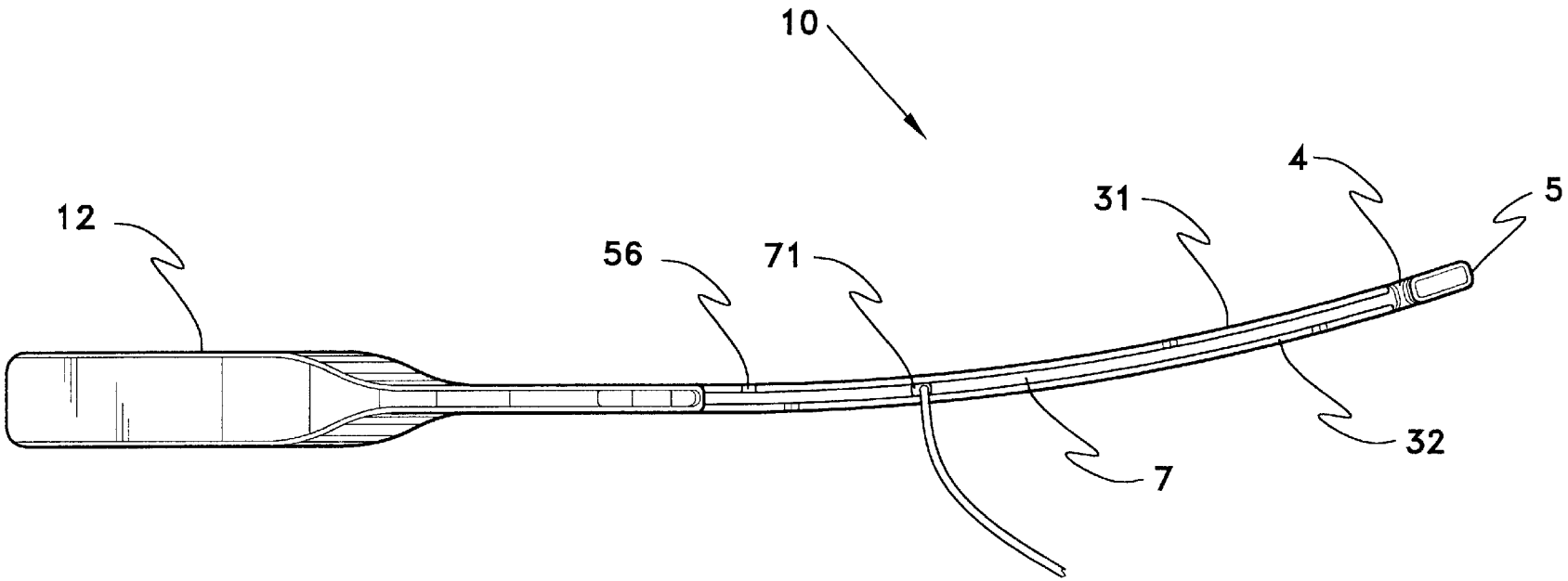
FIG. 2 is a bottom view of the blade of the hockey training aid as viewed in the direction of lines 2—2 of FIG. 1.

A bottom view of the blade 10 of FIG. 1 is shown in FIG. 2. A channel 7 defined along the lower edge of the blade 10 is visible in this view, showing the two sides or wells of the channel 31 and 32 with their inwardly extending flanges defining a longitudinally extending slit 73. Inside the channel 7, a bead 71 is shown attached to a string. The bead 71 is freely movable along this channel from the heel end of the blade near the notch 56 to the toe 5.

Figure 5A:
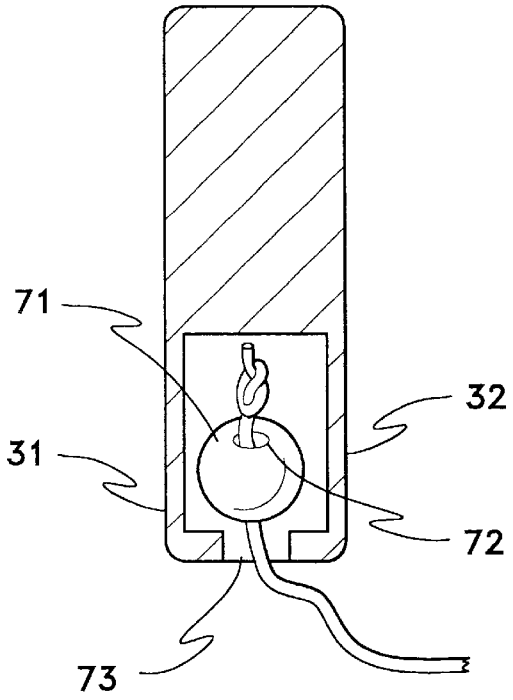
FIGS. 5A and 5B are sectional views of the channel along the lower edge of the blade along the lines 5A—5A and 5B—5B, respectively, of FIG. 1.
Figure 5B:
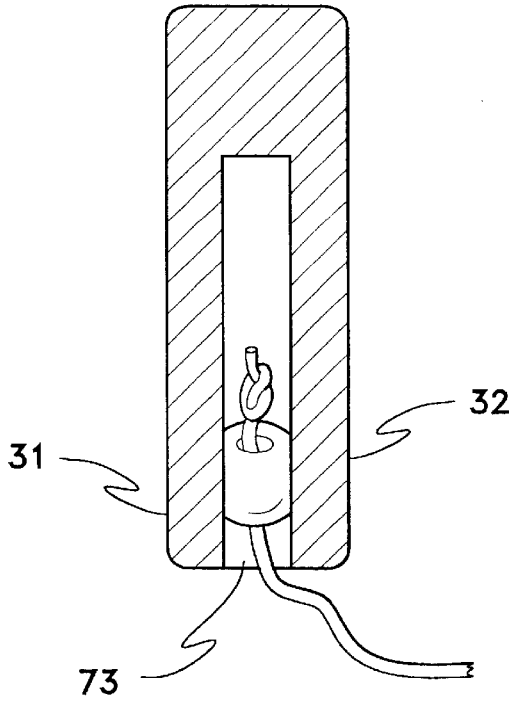

A sectional view of the channel 7 is shown in FIGS. 5A and 5B along the respective cross-section lines shown in FIG. 1. The bead 71 is free to move within the channel 7 defined by the channel walls 31 and 32, but is prevented from escaping from the channel by the narrow slit 73. In order to place the bead 71 inside the channel when the puck is being initially attached to the blade, a notch 56, shown in FIGS. 1 and 2, is used to snap-fit the bead 71 into the channel 7.

Although the notch 56 is shown located towards the back of the lower edge 13 of the blade, other locations for the notch 56 are also possible. For example, the notch 56 can be located anywhere along one of the two sidewalls 31 and 32 of the lower edge of the blade from the toe 5 to the heel 60, or, alternatively, anywhere along the bottom of the slit 73, as long as the bead 71 can be conveniently put into the channel 7 and held within the channel 7 during use of the blade and puck.

Figure 4:
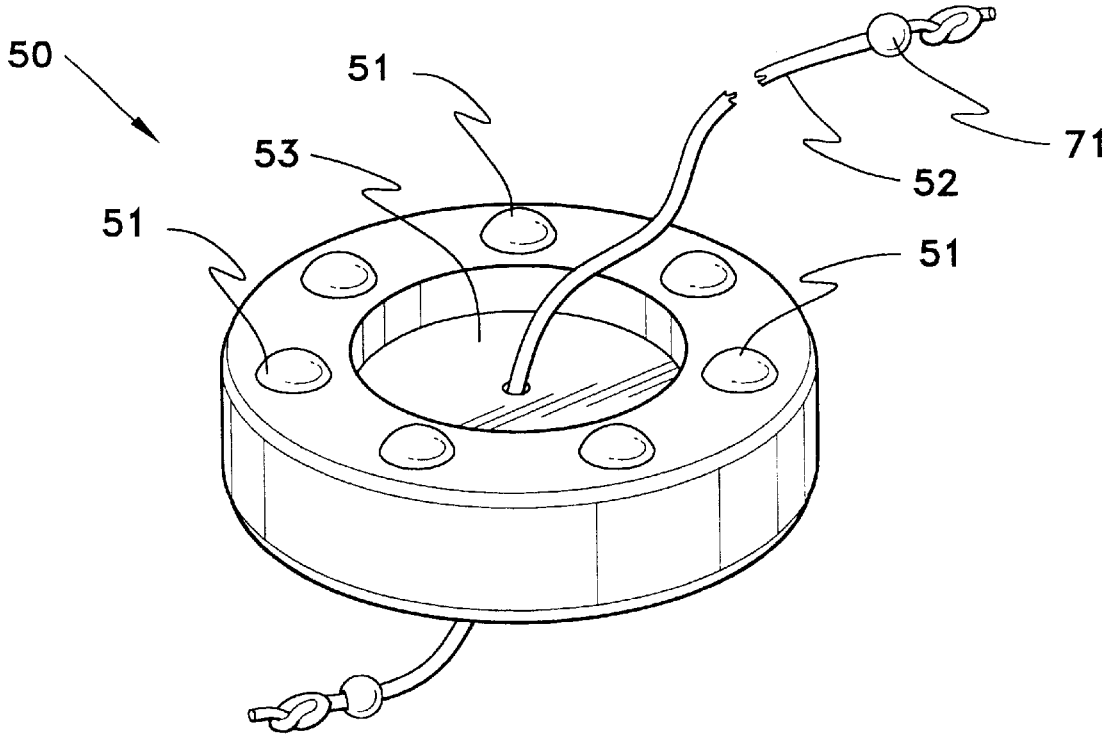
FIG. 4 is a perspective view of the hockey puck showing the string (tether).

The puck 50 is shown in FIG. 4, with a tether 52 attached at one end to the puck 50 and at the opposite end to the bead 71. Although the end of the tether 52 passing through the puck 50 is shown tied onto a second bead, a bead at this location is not necessary. The tether 52 simply needs to be adequately secured to the puck 50 in any suitable manner. The puck 50 is provided with circular depressions 53 on both faces of the puck. In addition, several raised features 51 are provided on both sides of the puck 50. The puck 50 is typically a street hockey puck made of hard plastic with a hole drilled through it.

During use of the hockey training aid 10, the puck 50 remains tethered to the blade 10 so that when the puck 50 is struck by the blade 10 during stick handling drills, it initially moves away from the blade 10 until the tether 52 reaches its limit. The tether 52 is preferably an inelastic cord, such as a string. Alternatively, the tether 52 may be elastic.

Referring back to FIG. 1, blade 10 is provided with hole 62 to permit an alternative attachment point for a tether 52, i.e., when it is not necessary for the tether 52 to move back-and-forth in the slit 73 of the channel 7 between the toe 5 and heel 60 of the blade 10 during the practice drills, such as for use in self passing drills. This hole 62 is placed at the top of the blade 10, preferably near the center of the blade 10. In this position, the blade 10 can be used for practicing self-passing drills. When the blade 10 is used in this manner, the tether 52 attached to the top hole 62 is preferably made from elastic, so that the puck 50 rebounds to the blade 10. Alternatively, the tether 52 may be an inelastic cord, such as a string.

The blade 10 is preferably a one-piece molded plastic having sufficient strength and toughness to withstand frequent and repeated impacts with a puck. Alternatively, the blade 10 may be made from wood, metal, fiberglass, carbon, or a composite material. The stick handle can be wood or plastic or any other suitable material, provided that it can be inserted into the aperture 12 and securely fastened.

Figure 6A:
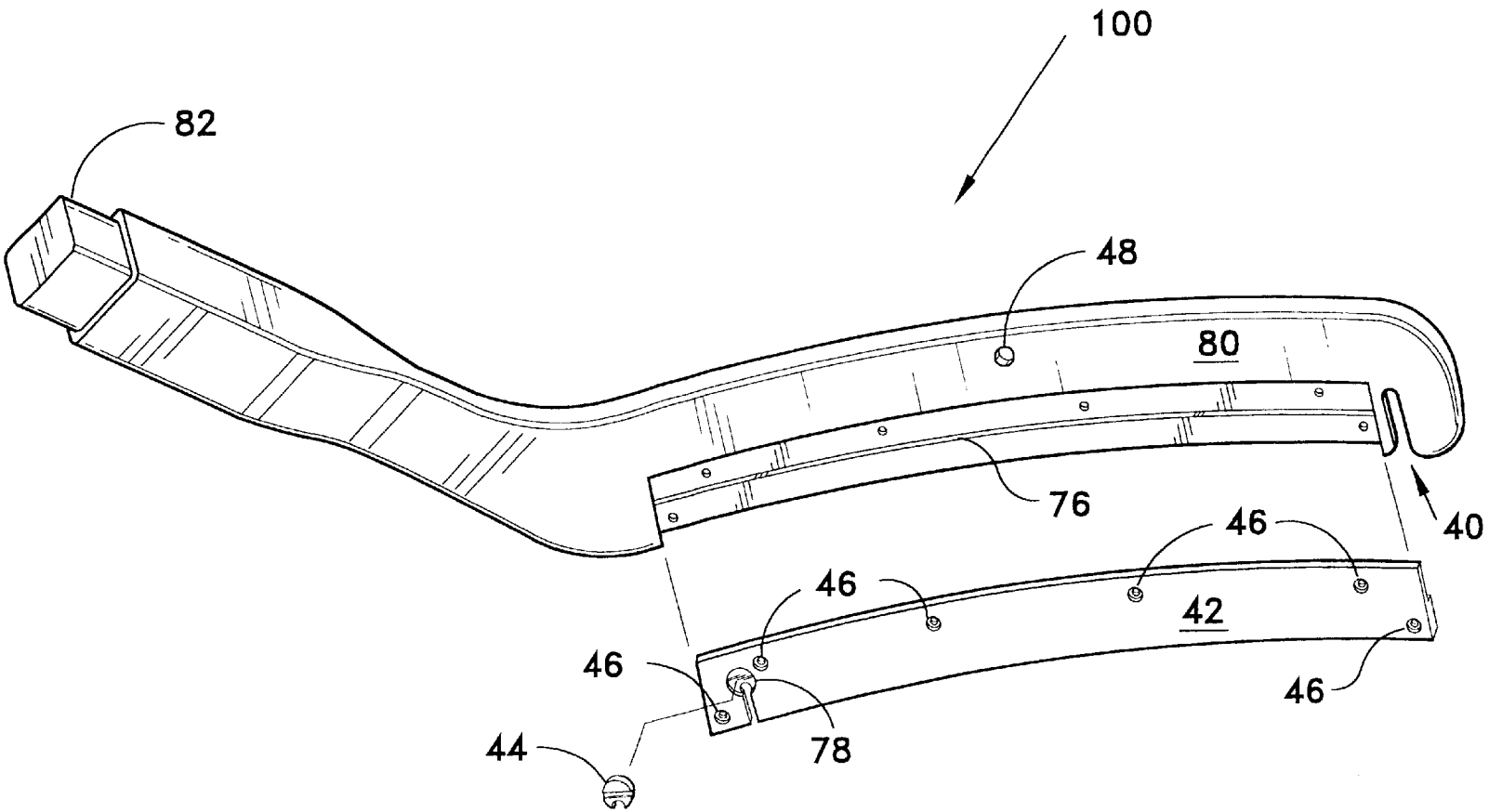
FIGS. 6A and 6B show exploded perspective views of an alternative embodiment of the blade in which a portion of the side of the blade is attached to the main portion of the blade to hold the movable bead inside the channel.

In FIG. 6A a modified hockey training aid 100 is shown which has a separate cover 42 that is attached to the blade 80 to enclose the channel 76. Preferably, the cover 42 is permanently attached using rivets that are placed in holes 46. A notch 40 is provided at the toe of the blade.

Figure 6B:
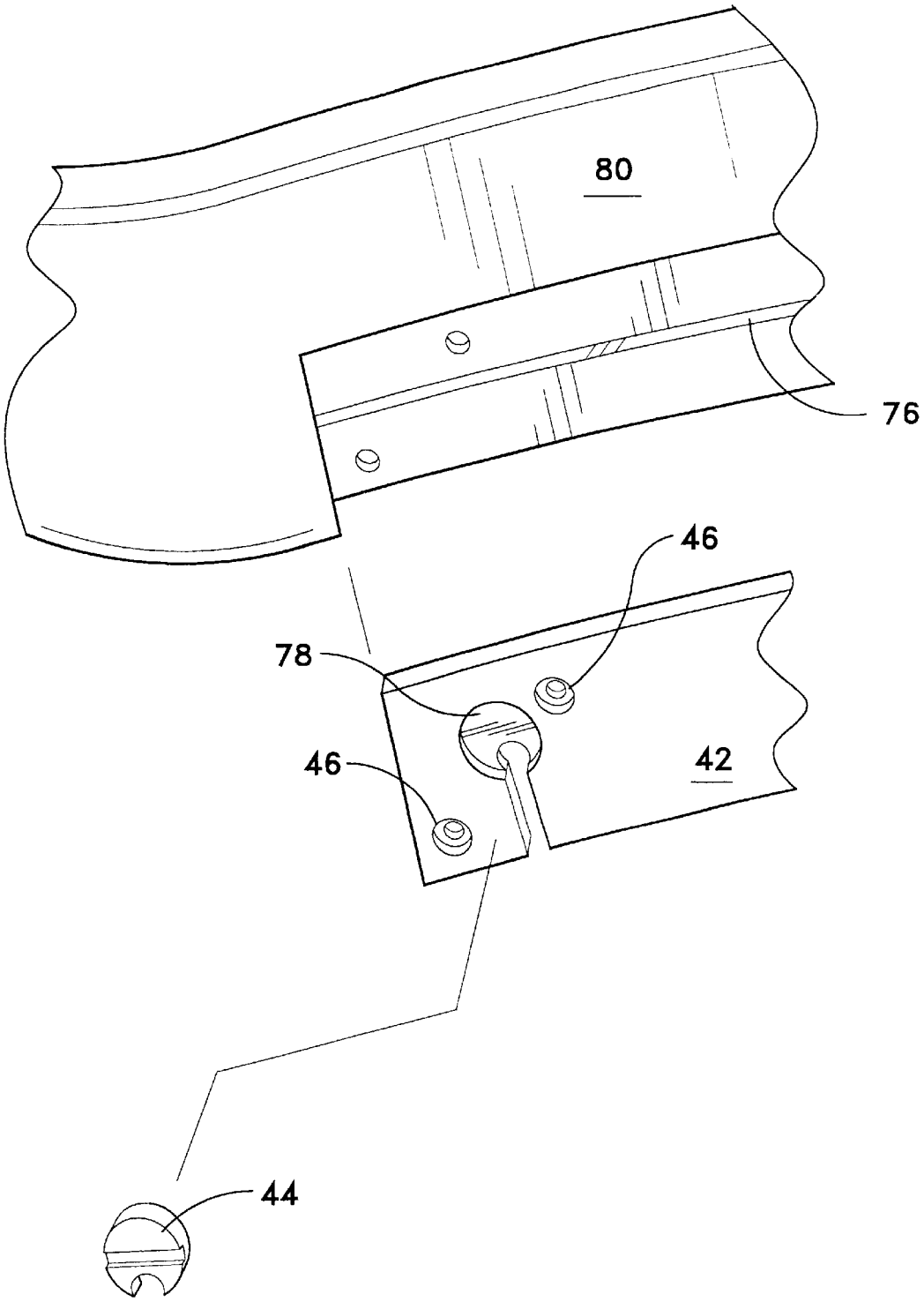

An opening 78, shown in detail in FIG. 6B, is provided to allow the user to insert the bead with the attached tether (not shown in FIGS. 6A and 6B for clarity), into the channel 76. A removable and/or rotatable retaining disc 44 is placed in the opening 78 to ensure that the bead does not inadvertently escape from the channel 76 during use.

FIG. 6A also shows an additional manner of attaching the blade 80 to a stick. In this case, a tenon 82 is used to insert into a hollow stick, preferably into an aluminum replacement shaft or a carbon-fiber-reinforced composite.

It is to be understood that the present invention is note limited to the embodiments described above, but encompasses any and all embodiments within the scope of the following claims.

I claim:

1. A hockey training aid comprising:

a flat blade having a shank adapted for receiving a hockey stick handle, the blade having two side surfaces for striking a puck, the blade having a toe, a heel, and a central portion extending between the toe and the heel, and a lower blade edge extending from the toe to the heel, the lower blade edge having a channel defined therein and a pair of walls extending inwardly defining a longitudinally extending slit below said channel;

a puck having a hole passing through the puck from a center of one face of the puck to a center of the opposite face of the puck;

a bead, the bead being slidably disposed in the channel defined in the lower blade edge, the bead being removable from the channel; and a tether having a first end attached to the puck and a second end attached to the bead;

wherein the tether extends out from the channel and is freely movable along the length of the slit.

2. The hockey training aid of claim 1, further comprising:

a bead insertion notch defined in the blade, the notch opening into said channel in order to provide an access to the channel in order to insert the bead into the channel.

3. The hockey training aid of claim 1, wherein the central portion of lower edge of the blade is raised, the heel and the toe protruding below the central portion of the lower edge of the blade, whereby the blade is adapted for contacting a supporting surface only at the heel and the toe of the blade.

4. The hockey training aid of claim 3, wherein the blade has a second notch defined therethrough at the toe of the blade.

5. The hockey training aid of claim 1, wherein said blade has an upper portion having a hole defined therein, the bead being removed from the channel and the tether being attached to the hole defined in the upper portion of said blade.

6. The hockey training aid according to claim 5, wherein said tether is elastic.

7. The hockey training aid according to claim 1, wherein said tether is elastic.

8. The hockey training aid according to claim 1, wherein said tether is an inelastic cord.

9. The hockey training aid according to claim 1, wherein said puck is a street hockey puck.

10. A hockey training aid comprising:

a flat blade having a shank adapted for receiving a hockey stick handle, the blade having two side surfaces for striking a puck, the blade having a toe, a heel, and a central portion extending between the toe and the heel, and a lower blade edge extending from the toe to the heel, the central portion of lower edge of the blade being raised, the heel and the toe protruding below the central portion of the lower edge of the blade, whereby the blade is adapted for contacting a supporting surface only at the heel and the toe of the blade;

a puck having a hole passing through the puck from a center of one face of the puck to a center of the opposite face of the puck; and, a tether having one end attached to the puck and an opposite end attached to the blade;

whereby the tether can freely move beneath the blade during use of the aid without being trapped between the lower edge of the blade and a supporting surface whenever the puck passes from one side of the blade to the other side.

11. The hockey training aid according to claim 10, wherein said blade has a lower edge having a channel defined therein extending from the heel to the toe, the training aid further comprising a bead slidably disposed in the channel, the opposite end of said tether being attached to said bead.

12. The hockey training aid according to claim 11, wherein said tether is elastic.

13. The hockey training aid according to claim 11, wherein said tether is an inelastic cord.

14. The hockey training aid according to claim 11, furthers comprising:

a bead insertion notch defined in the blade, the notch opening into said channel in order to provide an access to the channel in, order to insert the bead into the channel.

15. The hockey training aid according to claim 11, wherein said blade has a recess defined therein, the training aid further comprising a cover plate attached to the recess defined in said blade in order to define the channel.

16. The hockey training aid according to claim 10, wherein the blade has a second notch defined therethrough at the toe of the blade.

* * * * *